US009497991B2

(12) United States Patent
Besso et al.

(10) Patent No.: US 9,497,991 B2
(45) Date of Patent: Nov. 22, 2016

(54) SMOKING ARTICLE WITH COLOUR CHANGE SEGMENT

(71) Applicant: PHILIP MORRIS PRODUCTS S.A., Neuchatel (CH)

(72) Inventors: Clement Besso, Neuchatel (CH); Alexandre Camus, Columbier (CH); (Continued)

(73) Assignee: Philip Morris Products S.A., Neuchatel (CH)

( * ) Notice: Subject to any disclaimer, the term of this patent is extended or adjusted under 35 U.S.C. 154(b) by 400 days.

(21) Appl. No.: 14/355,635

(22) PCT Filed: Oct. 29, 2012

(86) PCT No.: PCT/EP2012/004521

§ 371 (c)(1),
(2) Date: May 1, 2014

(87) PCT Pub. No.: WO2013/068081

PCT Pub. Date: May 16, 2013

(65) Prior Publication Data

US 2014/0290678 A1 Oct. 2, 2014

(30) Foreign Application Priority Data

Nov. 7, 2011 (EP) ..... 11008825

(51) Int. Cl.

| | |
|---|---|
| ***A24D 3/06*** | (2006.01) |
| ***A24D 3/04*** | (2006.01) |
| ***A24D 1/02*** | (2006.01) |

(52) U.S. Cl.

CPC ..... *A24D 3/048* (2013.01); *A24D 1/025* (2013.01); *A24D 3/04* (2013.01); *A24D 3/061* (2013.01)

(58) Field of Classification Search

CPC ..... A24D 3/048; A24D 3/061

See application file for complete search history.

(56) References Cited

U.S. PATENT DOCUMENTS

| | | | |
|---|---|---|---|
| 4,984,589 | A | 1/1991 | Riedesser |
| 8,393,334 | B2 | 3/2013 | Cecchetto |

(Continued)

FOREIGN PATENT DOCUMENTS

| | | |
|---|---|---|
| CH | 394912 | 6/1965 |
| CN | 1137364 | 2/1996 |

(Continued)

OTHER PUBLICATIONS

Office Action issued in Korea for Application No. 10-2014-7012030 dated Sep. 17, 2015 (9 pages). English translation included.

(Continued)

*Primary Examiner* — Michael H Wilson
*Assistant Examiner* — Eric Yaary
(74) *Attorney, Agent, or Firm* — Mueting, Raasch & Gebhardt, P.A.

(57) ABSTRACT

The present invention relates to a smoking article (9) comprising a mouthpiece (1), a color change segment and a rupturable, fluid-containing capsule (5). The color change segment is adapted to interact with the fluid from the rupturable fluid-containing capsule such that, upon interaction, the color change segment shows a color change when the capsule is ruptured. The smoking article comprises a permeable outer wrapper which is in a first region covered with an impermeable coating such that the first region is impermeable, wherein a second region, which is not covered by the impermeable coating, is permeable.

13 Claims, 1 Drawing Sheet

(72) Inventors: Dorothy Tritz, Yverdon-les-Bains (CH); Charles Kuersteiner, Jouxtens-Mezery (CH)

(56) References Cited

U.S. PATENT DOCUMENTS

| | | | |
|---|---|---|---|
| 2002/0153017 | A1 | 10/2002 | Georgitsis |
| 2005/0076927 | A1 | 4/2005 | Schluter |
| 2005/0268926 | A1 | 12/2005 | Hsu |
| 2007/0068540 | A1 | 3/2007 | Thomas |
| 2008/0236602 | A1 | 10/2008 | Bereman |
| 2009/0293894 | A1 | 12/2009 | Cecchetto |
| 2010/0319718 | A1 | 12/2010 | Schluter |

FOREIGN PATENT DOCUMENTS

| | | |
|---|---|---|
| CN | 1604744 | 4/2005 |
| CN | 201667985 | 12/2010 |
| CN | 102046032 | 5/2011 |
| CN | 102781265 | 11/2012 |
| EP | 0745336 | 2/2002 |
| JP | 02-186970 A | 7/1990 |
| JP | 08-322540 | 12/1996 |
| JP | 2005-511107 | 4/2005 |
| JP | 2009-504175 | 2/2009 |
| JP | 2011-521656 | 7/2011 |
| KR | 10-2011-0022562 | 3/2011 |
| WO | WO 2007/060543 | 5/2007 |
| WO | WO2011/077141 | 6/2011 |
| WO | WO 2011/077141 | 6/2011 |

OTHER PUBLICATIONS

Office Action issued in China for Application No. 201280054562.3 dated Nov. 4, 2015 (10 pages). English translation included.

Office Action issued in China for Application No. 201280054562.3 dated Jun. 13, 2016 (14 pages). English translation included.

Office Action issued in Japan for Application No. 2014-540344 dated Aug. 27, 2015 (14 pages). English translation included.

Office Action issued in Kazakhstan for Application No. 2014/1606.1 dated Aug. 21, 2015 (7 pages). English translation included.

PCT International Search Report for International Application No. PCT/EP2012004521 dated Apr. 24, 2013 (2 pages).

SMOKING ARTICLE WITH COLOUR CHANGE SEGMENT

This application is a U.S. National Stage Application of International Application No. PCT/EP2012/004521, filed Oct. 29, 2012, which was published in English on May. 16, 2013, International Patent Publication WO 2013/068081 A1. International Application No. PCT/EP2012/004521 claims priority to European Application No. 11008825.9 filed Nov. 7, 2011.

The present invention relates to a smoking article comprising a mouthpiece, a rupturable fluid-containing capsule, and a colour change segment capable of changing colour. The invention also relates to a mouthpiece for such a smoking article.

Some smoking articles, such as filter cigarettes, typically comprise a cylindrical rod of tobacco cut filler surrounded by a paper wrapper and a cylindrical filter axially aligned in an abutting end-to-end relationship with the wrapped tobacco rod. Conventionally, the wrapped tobacco rod end and the filter are joined by a tipping paper, typically formed of a band of paper material that circumscribes the entire length of the filter and an adjacent portion of the wrapped tobacco rod.

A number of smoking articles in which tobacco is heated rather than combusted have also been proposed in the art. In heated smoking articles, an aerosol is generated by heating a flavour generating substrate, such as tobacco. Known heated smoking articles include, for example, electrically heated smoking articles and smoking articles, in which an aerosol is generated by the transfer of heat from a combustible heat source to a physically separate aerosol forming material. During smoking, volatile compounds are released from the aerosol forming substrate by heat transfer from the heat source and entrained in air drawn through the smoking article. As the released compounds cool they condense to form an aerosol that is inhaled by the consumer.

Smoking articles comprising a capsule which releases a fluid, such as menthol, are known.

WO 2011/077141 A1 discloses a filter for a smoking article, which is supposed to have an enhanced biodegradation rate by means of a capsule in the filter, wherein the capsule comprises a liquid capable of enhancing the disintegration of the smoking article. The liquid in the capsule may be colored, such as to enable a confirmation to the user that the capsule has been ruptured.

EP-A-1895863 describes a cigarette, wherein a capsule is provided in between a first absorbent member and a second absorbent member of a filter element. The capsule is adapted to release at least a portion of a fluid when the capsule is subjected to external force, such as squeezing, by the consumer.

However, the release of the fluid by such a capsule is only detectable by the change of flavour or smoke constituency of the smoking article.

Furthermore, this limited method of being able to identify the release of the fluid renders it difficult for a consumer to know whether the fluid has been released unintentionally, for instance upon storage, since the release of a fluid, such as menthol, would not necessarily be detectable after several days or weeks.

It would therefore be desirable to provide an additional means for identifying release of the fluid. It would be especially desirable to provide a solution that enables a consumer to use a sense other than smell or taste to determine release of the fluid.

It would also be desirable to provide a means that enables release of the fluid to be indicated to the consumer in a manner that remains visible.

Thus, according to the invention there is provided a smoking article comprising a mouthpiece with a colour change segment and a rupturable, fluid-containing capsule, wherein the colour change segment is adapted to interact with the fluid from the rupturable fluid-containing capsule such that, upon interaction the colour change segment shows a colour change visible from the outside of the smoking article when the capsule is ruptured.

A colour change provides a completely different way for a consumer to confirm the release of the fluid and has the further advantage that it is independent of the consumer's capacity to identify the release through a taste or flavour change.

The phrase "colour change segment" denotes a portion of the smoking article that changes colour when in contact with the fluid from the rupturable fluid-containing capsule. The colour change may comprise the generation of a colour that is different from the surrounding portion of the smoking article, the disappearance of a colour that is the same as the surrounding portion of the smoking article, the change from opaque to transparent of a segment, the change from transparent to opaque of a segment, the appearance of a motif, logo or other image, the change of a segment from any colour or mixture of colours to another colour or mixture of colours irrespective of whether these are the same or different from the surrounding portion of the smoking article or any other detectable change that comprises the appearance, disappearance or change of the colour or of a logo, image or motif of the portion of the smoking article. The colour change segment is preferably a segment of the mouthpiece, such as a filter segment, or a wrapper, such as a inner or outer wrapper.

The phrase "colour change" denotes the result that is visible in the colour change segment when the fluid contacts the segment.

The colour change preferably occurs in an outside layer of the smoking article. Where there are multiple layers, the colour change may occur in a layer that is not the outermost layer. This has the advantage that fluid that interacts with the colour change segment is preferably prevented from coming into direct contact with the consumer's lips or fingers.

Thus it is especially desirable that the outermost layer is an impermeable layer. This further reduces the chance of the fluid from coming into direct contact with the consumer's lips or fingers. Thus, it is especially preferred that the impermeable layer is water impermeable.

The colour change segment preferably comprises part of a layer, the layer thus undergoing a colour change in a localized portion when it comes into contact with a certain fluid.

Preferably the colour change segment comprises at least a part of one of the outside layers of the mouthpiece.

The mouthpiece in which the colour change segment is located may be opaque or transparent. It is preferred that the mouthpiece is opaque. This allows the consumer to see more easily the colour change since an opaque background provides greater contrast than a transparent background.

The term "opaque" is used to describe a material which prevents at least a significant proportion of incident light from passing through, so that it is not possible to see through the material. Preferably, "opaque" denotes a total percentage light transmission of about 40% or less, more preferably about 30% or less, even more preferably about 25% or less, most preferably 15% or less, as measured using a Hunterlab Colorquest XE Spectrophotometer.

The outer layer of the mouthpiece may be a wrapper, which is at least partially wrapped around at least part of the mouthpiece.

Smoking articles according to the invention comprising a mouthpiece and a colour change segment may be in the form of filter cigarettes or other smoking articles in which tobacco cut filler or other smokable material is combusted to form smoke. The invention additionally encompasses smoking articles in which tobacco material or another aerosol-generating substrate is heated to form an aerosol rather than combusted and smoking articles in which an aerosol, in particular a nicotine-containing aerosol, is generated from a tobacco material, tobacco extract, or alternative nicotine source or another aerosol generating substrate, without combustion or heating.

In the following description, the term 'mainstream smoke' is used to describe both mainstream smoke produced by combustible smoking articles, such as filter cigarettes, and mainstream aerosols produced by non-combustible smoking articles, such as heated or non-heated smoking articles of the types described above.

As used herein, the terms 'upstream' and 'downstream' are used to describe the relative position of portions or components of mouthpieces and smoking articles according to the invention in relation to the direction of mainstream smoke drawn through the mouthpieces and smoking articles during use thereof. For example, in a mouthpiece where the colour change segment is upstream of a mouth end segment, mainstream smoke is drawn first through the colour change segment and then through the mouth end segment.

As used herein, the term 'length' denotes the dimension in the longitudinal direction of flavour release segments, mouthpieces and smoking articles according to the invention.

In a preferred aspect, the mouthpiece comprises a filter and the colour change may occur in the filter.

Thus, when the fluid is released from the capsule, the consumer sees a colour change on the outside of the filter, and therefore knows that the fluid has been released. The release of fluid may be triggered by applying a pressure on the filter, such as by squeezing the filter, so that the capsule breaks and releases the fluid.

Preferably, the colour change may be effected in a predetermined area, such that a predetermined form, such as a trademark, logo or other motif is visible to the consumer.

In one aspect, the fluid of the capsule is coloured. Thus, the fluid itself can initially contain the desired colourant which is visible by the consumer when the fluid is released from the capsule. In this case, it is preferred that the colour change segment comprises a material that can absorb the coloured fluid and so change colour.

In another aspect, the fluid may interact with a colourant provided in the colour change segment. Thus, the fluid, which may not itself comprise a colourant, interacts with, and thereby activates a colourant provided in the colour change segment, such that a colour change is visible to the consumer. This provides the benefit, that only colourant in some areas of the filter element has to be provided, while the released fluid from the capsule is not coloured in other regions of the filter element.

In yet another aspect, neither the fluid nor the colour change segment comprise a colourant but their interaction generates a colour when the fluid and the colour change segment come into contact with each other.

The capsule may be a rupturable fluid reservoir comprising about 0.1 ml to about 1.0 ml of a fluid. Suitable capsules are preferably spherical or ellipsoidal. Preferred diameters are from about 2.9 mm to about 6.2 mm.

In a preferred aspect, the colour change segment may be provided on a wrapper that circumscribes at least a portion of the mouthpiece. A smoking article according to the invention may comprise more than one wrapper. In such an embodiment, the, colour change segment may be provided on the inside of an outer wrapper.

In some embodiments, the capsule may comprise an additive, which modifies the characteristics of the smoke of the smoking article. Such additives may comprise flavours, neutralizing agents, or other smoke modifiers, such as chemical reagents. Additionally, the additives may also include diluents, solvents or processing aids. In a preferred embodiment, the additives may include one or more flavours, such as liquid or solid flavours and flavour formulations or flavour-containing materials. Suitable flavours include, but are not limited to, menthol, mint, such as peppermint and spearmint, cocoa, licorice, citrus and other fruit flavours, gamma octalactone, vanillin, ethyl vanillin, breath freshener flavours, spice flavours such as cinnamon, methyl salicylate, linalool, bergamot oil, geranium oil, lemon oil, ginger oil and tobacco flavour.

Preferably, the capsule containing the fluid effecting the colour change is provided in a porous segment of the mouthpiece so that the fluid contained within the capsule readily reaches the outside of the porous segment when the capsule is ruptured. In this case, the fluid is believed to travel by means of a capillary effect in the porous segment. If the colour change segment is located in a layer adjacent to and circumscribing the porous segment, the colour change occurs as soon as the fluid reaches the outside of the porous segment.

The porous segment may be a porous filter segment. A suitable porous filter segment may be formed of cellulose acetate, preferably with a low filtration efficiency, having a high sorptivity. The porous filter segment may in particular be made of a high single denier type material with a weight of about 8.0 g per 9 km.

The low filtration efficiency of the porous filter segment allows that the fluid flows towards the inner surface of the layer comprising the colour change segment, to enable colour change and indicate that the capsule has released the fluid.

In one embodiment, the mouthpiece may comprise only the porous filter segment.

In a preferred embodiment, the smoking article comprises first and second capsules located in first and second porous filter segments respectively, where the first segment is upstream of the second segment. The first capsule may contain the fluid for effecting the colour change and the second capsule may contain an additive such as a flavourant. In a preferred aspect, the second filter segment has a lower sorptivity than the first segment such that fluid released from the second capsule moves very slowly through the second filter segment, whilst the fluid from the first capsule rapidly reaches the outer surface of the first filter segment. This has the advantage that the indicator that the flavourant is released may be remarked by the consumer before or simultaneously as the flavourant reaches the consumer's mouth.

This has the further advantage that the fluid effecting the colour change does not generally reach the mouth of the consumer or change the colour of the mouth end of the second porous filter segment.

Preferably, the second filter segment has a minimum length of about 7 mm and is a fibrous filter material, such as cellulose acetate. Additional absorbent material, such as activated carbon, may be present in this segment.

The second filter segment preferably has a high filtration efficiency, i.e. a low sorptivity. This has the advantage of preventing or reducing sorption of the released fluid into the second filter segment.

In one embodiment, the second porous filter segment is a mouth end filter segment. Preferably it has a length of about 10 mm or longer.

It is particularly preferred that the fluid that causes the colour change remains substantially in the first filter segment. Thus it is preferred that at least about 80%, more preferably about 90% of the fluid remains in the first filter segment.

In one embodiment, the mouthpiece comprises a fluid-impermeable inner wrapper. Thus, the fluid that effects the colour change will, once the capsule is ruptured, reach but not traverse the inner wrapper. This prevents contact with the consumer, especially the consumer's fingers and so maintains a dry feeling to the touch, which is typically desired by consumers.

Preferably, an inner wrapper is a wrapper which circumscribes the at least one filter segment of the filter element. The inner wrapper may connect several filter segments of a filter element, preferably up to five segments. The individual filter segments may in particular comprise absorbents, flavours, plant materials, botanicals or spices. Some or all of these segments may be at least partially visible through one or more transparent sections of inner wrapper. The transparent sections may be die-cut sections.

In one embodiment, the filter element comprises at least an opaque, permeable inner wrapper. In particular, the inner wrapper may have a higher sorptivity than the respective bordering filter segments. Thus, the inner wrapper absorbs the fluid provided by the capsule in a high concentration, and therefore provides the colour change segment. The opaque, permeable inner wrapper may be formed by a paper wrapper with a weight from about 20 grams per square meter (gsm) to about 30 gsm.

The inner wrapper may be provided with a colourant. The colourant may be arranged at the inner side of the inner wrapper. For a permeable inner wrapper, the colourant may be distributed throughout the inner wrapper.

In one embodiment, the outer wrapper is opaque and comprises a cut-out. The cut-out may be any type of opening, however a die-cut opening is preferred. The outer wrapper may be formed from a standard tipping paper, in particular with a weight of about 40 to about 60 gsm. Uncontrolled flow of air through the opening in the outer wrapper is usually prevented by the combination with a substantially impermeable inner wrapper.

In one embodiment, the outer wrapper is transparent and partially printed or embossed. By means of printing or embossing, the outer wrapper may only be transparent in predetermined areas, namely in the areas where the colour change occurs. The print may provide marketing information or may serve the design of the smoking article. Furthermore, the outer wrapper may be embossed, wherein the embossing serves the purpose to provide a similar mouth feel to the consumer as for a standard paper outer wrapper. Furthermore, the print may interact with the colour change effect, such that the colour change effect changes the shape of a previously printed image in the area of colour change effect.

Preferably, the outer wrapper is impermeable.

Alternatively, the outer wrapper is permeable, and is provided in a first region with an impermeable coating, such as a varnish, so as to render the first region substantially impermeable. Thus, the permeable region of the outer wrapper comprises the colour change segment, and the fluid will effect a colour change in the outer wrapper in the permeable region.

The inside of the filter typically comprises at least one filter segment with capsule arranged therein, wherein the capsule encloses a fluid, which is released when pressure is applied thereon.

In a preferred embodiment, the at least one filter segment is circumscribed by an inner wrapper, which is formed from a transparent, impermeable film material, in particular a cellulose material, which is treated with an anti-staining varnish. Around the inner wrapper, an outer wrapper made from standard tipping paper is arranged which comprises a die-cut opening, such that a window is provided in the tipping paper. The window allows a consumer to see the colour change effect provided on the inside of the inner wrapper after breaking the capsule. In this embodiment, the colour change is effected, when the fluid of the capsule reaches the transparent inner wrapper. The consumer can observe the colour change through the die-cut opening on the outer wrapper. For example, the colour of the cellulose acetate of the filter segment will change due to the colour of the fluid that has been released.

In a further preferred embodiment, the at least one filter segment is circumscribed by a transparent film, and the outer wrapper is formed by a transparent tipping film. The transparent tipping film may at least partially be printed or embossed. Thus, at least through the unprinted areas of the outer wrapper, the colour change at the inside of the inner wrapper can be seen. In this embodiment, the filter segment changes its colour when it comes into contact with the fluid for effecting the colour change. The consumer can see the colour change through the transparent inner and outer wrappers. Preferably, only a transparent window is provided in the outer wrapper, while the remaining outer wrapper is embossed and/or printed such that it is not transparent. The outer wrapper or inner wrapper may both be impermeable to the fluid of the capsule.

In a further preferred embodiment, the at least one filter segment is wrapped with a permeable, opaque inner wrapper, and a transparent, impermeable outer wrapper. Thus, when the inner wrapper interacts with the fluid of the ruptured capsule, a colour change can be seen through the transparent outer wrapper. In this embodiment, the colour change effect can be seen when the fluid reaches the permeable inner wrapper and interacts with it, as at least an unprinted transparent portion of the outer wrapper is provided in this region. Thus, the colouring of the porous inner wrapper confirms that the flavour has been delivered.

In a further preferred embodiment, a permeable, opaque inner wrapper circumscribes the at least one filter segment, and an at least partially permeable opaque outer wrapper is wrapped around the inner wrapper. The partial permeability of the outer wrapper may be achieved by treating only a portion of the outer wrapper with an anti-staining varnish. Thus, the untreated portion of outer wrapper is permeable and absorbs the fluid and, thus, a colour change will be effected on the outside of the outer wrapper. In this embodiment, the colour change is effected, when the fluid is dispersed through permeable inner wrapper and is then absorbed by the permeable portion of the outer wrapper.

Thus, the permeable portion of the outer wrapper will change its colour, and the consumer sees that the flavour has been delivered.

Mouthpieces for use in invention may be single segment mouthpieces or filters.

Alternatively, mouthpieces for use in the invention may be multi-component mouthpieces comprising one or more segments in addition to the colour change segment.

Mouthpieces for use in the invention may comprise one or more segments upstream of the colour change segment.

Alternatively or in addition, mouthpieces for use in the invention may comprise one or more segments downstream of the colour change segment. This advantageously reduces the chance that the fluid that interacts with the colour change segment comes into direct contact with a consumer's mouth.

Mouthpieces for use in the smoking articles according to the invention may comprise one or more additional segments comprising fibrous filtration materials, such as cellulose acetate tow.

The mouth end segment of the mouthpiece may comprise a hollow tube or recess. The hollow tube or recess may be formed when the mouthpiece is attached to a rod of smokeable material by, for example, tipping paper to form a smoking article according to the present invention. Preferably, the recess further comprises a cylindrical element that adds structural strength to the tube, for example a paper or carton tube that is overwrapped by the tipping material. Recess filters are well known in the art, for example, in European patent application WO-A-2004/089124.

The mouthpiece may comprise a restrictor segment. A restrictor segment affects the resistance to draw and other fluid dynamics of the smoking article and also affects the formation of carbon monoxide and carbon dioxide. Restrictors in smoking articles are known in the art, for example from the International patent application WO-A2-2008/059377.

The mouthpieces may comprise a mouth end segment downstream of the colour change segment comprising a plug of cellulose acetate tow or other fibrous filtration material.

Mouthpieces for use in the invention may include one or more additional segments comprising sorbents (for example, activated carbon or silica gel), plant material (for example, tobacco lamina), flavorants and other smoke modifying agents.

The one or more additional segments may be used to achieve a desired overall plasticiser content in the mouthpiece.

Alternatively or in addition, the one or more additional segments may be used to achieve a desired overall resistance to draw (RTD) of the mouthpiece.

Mouthpieces for use in the invention may have a resistance to draw (RTD) of, for example, between about 100 mm WG (water gauge) and about 180 mm WG as measured in accordance with ISO 6565:2002.

Mouthpieces for use in the invention may have an external diameter of, for example, between about 5 mm and about 8.5 mm.

Mouthpieces for use in the invention may have a length of, for example, between about 20 mm and about 50 mm.

Where mouthpieces for use in the invention comprise a mouth end segment downstream of the colour change segment, the length of the mouth end segment may be, for example, between about 3 mm and about 15 mm, for example between about 6 mm and about 12 mm.

Where the mouth end segment comprises a hollow tube or recess, the length of the mouth end segment may be, for example, between about 3 mm and about 8 mm.

Mouthpieces for use in the invention may be incorporated into a wide variety of different types of smoking articles. For example, mouthpieces for use in the invention may be incorporated into combustible smoking articles, such as filter cigarettes, comprising a wrapped rod of tobacco cut filler or other smokable material, which is combusted during smoking.

Alternatively, mouthpieces for use in the invention may be incorporated into non-combustible, heated smoking articles of the type described above in which material is heated to form an aerosol, rather than combusted. For example, mouthpieces for use in the invention may be incorporated into heated smoking articles comprising a combustible heat source and an aerosol-generating substrate downstream of the combustible heat source, such as that disclosed in WO-A-2009/022232. Mouthpieces for use in the invention may also be incorporated into heated smoking articles comprising non-combustible heat sources, for example chemical heat sources or electrical heat sources.

Alternatively, mouthpieces for use in the invention may be incorporated into non combustible smoking articles of the type described above in which an aerosol is generated from an aerosol generating substrate without combustion or heating, such as those described in WO-A-2008/121610 and WO-A-2010/107613.

In one embodiment, smoking articles according to the invention may comprise a wrapped rod of tobacco cut filler or other smokable material attached to the mouthpiece by a tipping paper.

In another embodiment, smoking articles according to the invention may comprise an aerosol generating substrate upstream of the mouthpiece.

Smoking articles according to the invention may comprise mouthpieces with ventilation in order to mix ambient air with mainstream drawn through the mouthpiece by a consumer during smoking. For example, one or more circumferential rows of perforations may be provided at a location along the mouthpiece in order to mix ambient air with mainstream smoke drawn through the mouthpiece by a consumer during smoking. Preferably, the one or more circumferential rows of perforations or other ventilation means are located at least 12 mm from the mouth end of the mouthpiece.

Smoking articles according to the invention may have a ventilation level of, for example, between about 20% and about 80%, as measured in accordance with ISO 9512:2002.

Smoking articles according to the invention may have an overall length of, for example, between about 60 mm and about 128 mm.

Smoking articles according to the invention may have an external diameter of, for example, between about 5 mm and about 8.5 mm, for example between about 5 mm and about 7.1 mm for slim sized smoking articles or between about 7.1 mm and about 8.5 mm for regular sized smoking articles.

The mouthpiece for use in the present invention may comprise a filter. The filter may comprise one or more fibrous filter segments.

Where a filter comprises multiple segments, it may be produced by forming separate continuous rods comprising multiple units of each individual segment of the filter. Then these separate rods are combined in a known manner in one or more stages to form a continuous filter rod comprising multiple units of the filter. The continuous filter rod may then be subsequently severed at regular intervals by a cutting mechanism to yield a succession of discrete filters according to the invention.

Preferably, smoking articles according to the present invention comprise a wrapped rod of tobacco cut filler. Preferably, smoking articles according to the present invention have a total nicotine free dry particulate matter (NFDPM) or "tar" delivery of up and about 10 mg. More preferably, the "tar delivery" is between 1 mg and 10 mg and more preferably about 6 mg.

Preferably, the colour change segment, if it is located in the mouthpiece, abuts the wrapped rod of smokable material.

The invention will now further be described with reference to exemplary embodiments as shown in the figures.

Figure 1:
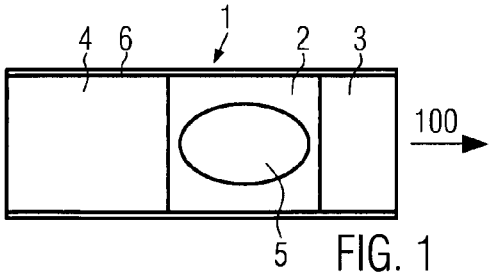
FIG. 1 shows a cross sectional view of a filter element according to a first embodiment of the invention.

In FIG. 1, a mouthpiece in the form of a filter element 1 according to a first embodiment of the present invention is shown. The filter element 1 is generally comprised of a first filter segment 2, a rod end filter segment 3, and a mouth end filter segment 4. The filter segments 4, 2, 3 are arranged adjacent to each other in the longitudinal direction 100. The longitudinal direction 100 corresponds to the axial direction of the cylindrical filter element 1. The rod end filter segment 3 is arranged such that it will border to a smoking material rod in a smoking article, while the mouth end filter segment 4 is arranged downstream at the mouth end of the smoking article.

In the first filter segment 2, a capsule 5 is provided. The capsule 5 encloses a fluid, which is released, when the capsule 5 is subjected to pressure and therefore ruptures. The capsule 5 is embedded in the filter material of the first filter segment 2, namely cellulose acetate. The rod end filter segment 3 and the mouth end filter segment 4 may also be manufactured from cellulose acetate.

Preferably, the sorptivity of the first filter segment 2 is higher than the sorptivity of the mouth end filter segment 4 or the rod end filter segment 3. Thus, the fluid released by the capsule 5 remains substantially in the first filter segment 2, and is quickly distributed to the outer circumference thereof.

The fluid in the capsule 5 comprises a flavourant, and, thus, when it is released, modifies the flavour of the smoking article. However, in other embodiments, the fluid comprised in capsule 5 may only comprise an additive, which modifies the constituency of the smoke provided by a smoking element.

The fluid in the capsule 5 comprises a colourant, such that upon release of the fluid, the material of the first filter segment 2 is coloured.

The first filter segment 2, the rod end filter segment 3 and the mouth end filter segment 4 are circumscribed by an inner wrapper 6, such that they are connected to each other. The inner wrapper 6 may either be formed from a impermeable transparent material, or from a permeable opaque material. However, in any case the released fluid will effect a colour change, which is visible on the outside of the filter element 1. In those embodiments, wherein the fluid comprised in the capsule 5 does not comprise a colourant, a colourant may be provided either in the first filter segment 2, or on the inner wrapper 6, such that when the fluid reaches the colourant a colour change will be effected.

It is emphasized, that the rod end filter segment 3 is optional, and that the first filter segment 2 may also be provided at the end of the filter element 1, such that it borders directly at the smoking material rod. In further embodiments, only one filter segment with the capsule therein may be provided in the filter element.

Figure 2:
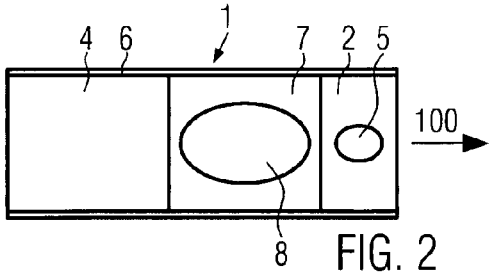
FIG. 2 shows a cross sectional view of a filter elementaccording to a second embodiment of the invention.

In FIG. 2 a second embodiment of a mouthpiece in the form of a filter element 1 according to the invention is shown. The filter element 1 comprises a first filter segment 2 with a capsule 5 arranged at an upstream side that is the rod end side of the filter element 1. A second filter segment 7, with a second capsule 8 is provided bordering to the first filter segment 2 in a downstream location.

In some embodiments, the second filter segment 7 may be shorter than the first filter segment 2 in the longitudinal direction 100. The shorter length is possible, as the filter material of the second filter segment 7 comprises a lower sorptivity than the filter material of the first filter segment 2, and therefore, the fluid from the second capsule 8 is less far dispersed than the fluid of the capsule 5 of the first filter segment 2.

Furthermore, bordering in the downstream direction to the second filter segment 7, a mouth end filter segment 4 is provided. The filter segments 4, 7, 2 are arranged adjacent to each other in the longitudinal direction 100. The respective filter segments 2, 7, 4 are circumscribed by the inner wrapper 6. The capsule 5 comprises a fluid with a colourant, wherein the second capsule 8 comprises a fluid with an additive, such as a flavourant. When the consumer squeezes the filter element 1, the first and the second capsules 5, 8 break. The first filter segment 2 has a higher sorptivity than the second filter element 7, such that dispersion of the fluid of the first capsule 5 in the first filter segment 2 is effected more quickly than the dispersion of fluid in the second filter segment 7. Thus, the fluid of the first capsule 5 quickly reaches the inner wrapper 6 and provides the colour change effect thereon. The inner wrapper 6 may either be a impermeable transparent material or a permeable opaque material as specified in the previous embodiment. As the colour change function and the flavourant release function is provided by different capsules, a more localized provision of the colour change effect can be obtained, while preventing that colourant reaches the consumer's mouth. Furthermore, the mouth end filter segment prevents that the flavourant is dispersed in a liquid form to a consumer's mouth.

Figure 3:
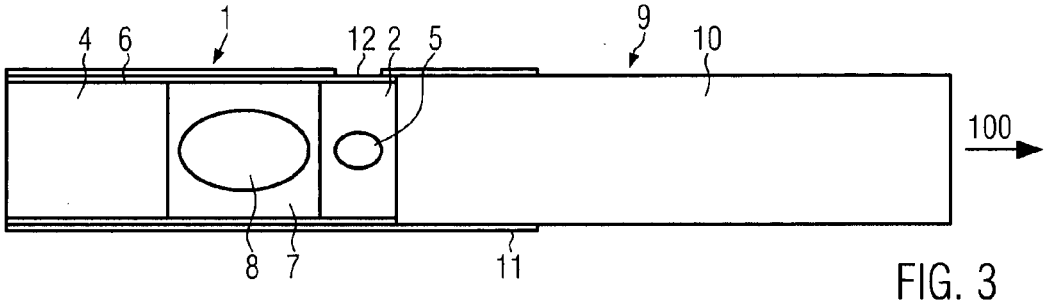
FIG. 3 shows a cross sectional view of a smoking article according to a first embodiment of the invention.

In FIG. 3, a first embodiment of a smoking article 9 according to the present invention is shown. The smoking article 9 comprises the filter element 1 according to the second embodiment as shown in FIG. 2. In particular, the smoking article 9 comprises a smoking material rod 10, which is connected by means of an outer wrapper 11 to the filter element 1. The outer wrapper circumscribes the downstream portion of the smoking material rod and the filter element 1. The outer wrapper 11 is formed from an opaque material, in particular a standard tipping paper. The outer wrapper 11 comprises a cut-out 12 in the area of the first filter segment 2. The inner wrapper 6 is a transparent impermeable wrapper. Thus, when the smoking article 9 is squeezed in the area of the filter element 1, the capsules 5, 7 break and their fluid is released, wherein the fluid of the first capsule 5 quickly distributes through the highly sorptive first filter segment 2 and the coloured material of the first filter segment 2 is visible through the transparent inner wrapper 6 and the cut-out 12 in the outer wrapper 11.

However, the remaining mouth-end of the filter element 1 provides the usual look and feel of a standard tipping paper.

Figure 4:
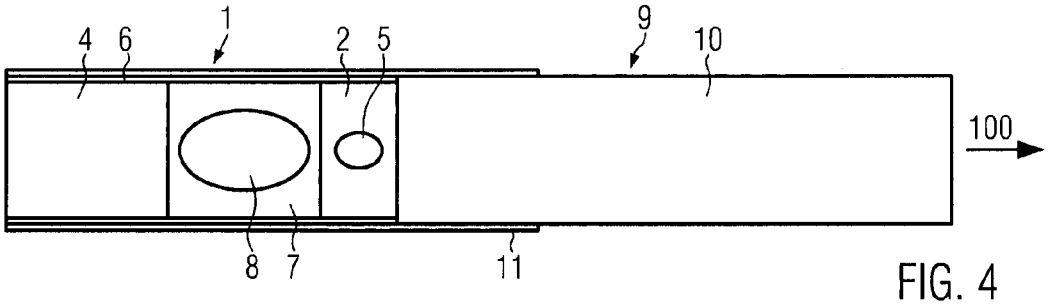
FIG. 4 shows a cross sectional view of a smoking article according to a second embodiment of the invention.

In FIG. 4 a second embodiment of a smoking article 9 according to the present invention is shown. The smoking article 9 according to the second embodiment comprises as well a filter element 1 according to the second embodiment as shown in FIG. 2. However, in difference to the first embodiment of the smoking article 9, the inner wrapper 6 and the outer wrapper 11 are both formed from a transparent material. The transparent material of the outer wrapper 11 may be printed or embossed. Nevertheless, in the region of the first capsule 5, a transparent window is provided in the outer wrapper 11, which allows the visibility of the colour change effected by the fluid provided by the first capsule 5. The inner wrapper 6 in the second embodiment of the smoking article 9 may either be an opaque permeable wrapper, or a transparent impermeable wrapper, as the outer wrapper 11 provides the necessary impermeability to prevent that fluid comprising colourant reaches the outside.

The configuration and arrangement of the inner and outer wrappers as described with reference to FIGS. 3 and 4 can be applied for any type of filter segment configuration in the filter element. For example a filter element 1 according to FIG. 1 could be provided, or a filter element with only one filter segment comprising a capsule, enclosing a fluid with a colourant and an additive, such as flavourant.

Figure 5:
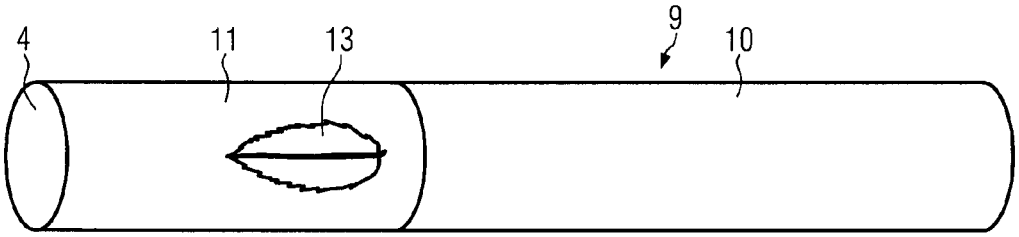
FIG. 5 shows a perspective view of a smoking article according to an embodiment of the invention.

In FIG. 5, a smoking article 9 according to an embodiment of the present invention is shown in a perspective view. As can be seen, a colour change effect in the form of an image 13 is visible on the outside of the outer wrapper 11. Thus, before rupturing the capsule no such symbol 13 is visible and, once ruptured, the symbol quickly appears. The symbol 13 may be a representation of the type of flavourant released, such as a mint leave or the like.

The invention claimed is:

1. A smoking article comprising a mouthpiece, a colour change segment and a rupturable, fluid-containing capsule, wherein the colour change segment is adapted to interact with the fluid from the rupturable fluid-containing capsule such that, upon interaction, the colour change segment shows a colour change when the capsule is ruptured, wherein the smoking article comprises a permeable outer wrapper which is in a first region covered with an impermeable coating, such that the first region is impermeable, wherein a second region, which is not covered by the impermeable coating, is permeable, wherein the permeable second region comprises the colour change segment, and the impermeable coating is varnish.

2. The smoking article according to claim 1, wherein the outer wrapper is opaque and comprises a cut-out.

3. The smoking article according to claim 1, wherein the outer wrapper is transparent.

4. The smoking article according to claim 1, wherein the fluid of the rupturable capsule is coloured.

5. The smoking article according to claim 1 wherein the fluid interacts with a colourant provided in a portion of the mouthpiece.

6. The smoking article according to claim 1, wherein the rupturable capsule is provided in a porous segment.

7. The smoking article according to claim 1, wherein the smoking article comprises first and second capsules located in a first upstream and a second downstream porous filter segment respectively, the first capsule containing the fluid for effecting the colour change and the second capsule containing an additive such as a flavourant, and further wherein the second filter segment has a lower sorptivity than the first filter segment such that fluid released from the second capsule moves more slowly through the second filter segment, and fluid from the first capsule, when ruptured, moves more quickly through the first filter segment.

8. The smoking article according to claim 1, wherein the mouthpiece comprises a filter segment arranged downstream of the capsule.

9. The smoking article according to claim 1, wherein the outer wrapper is partially printed or embossed.

10. The smoking article according to claim 1, comprising a permeable, opaque inner wrapper.

11. The smoking article according to claim 2, wherein the fluid of the rupturable capsule is coloured.

12. The smoking article according to claim 3, wherein the fluid of the rupturable capsule is coloured.

13. The smoking article according to claim 2, wherein the fluid interacts with a colourant provided in a portion of the mouthpiece.

* * * * *